United States Patent [19]

Hill et al.

[11] 4,018,630

[45] Apr. 19, 1977

[54] METHOD OF PREPARATION OF DISPERSION STRENGTHENED SILVER ELECTRICAL CONTACTS

[75] Inventors: James S. Hill, Cranford; Emil L. Carbone, Paramus; Victor G. Mooradian, Summit; Walter G. Keyes, Spotswood, all of N.J.

[73] Assignee: Engelhard Minerals & Chemicals Corporation, Murray Hill, N.J.

[22] Filed: Sept. 5, 1975

[21] Appl. No.: 610,525

[52] U.S. Cl. ..... 148/11.5 P; 29/420.5; 75/173 A; 252/514

[51] Int. Cl.[2] ..... H01B 1/02; C22C 1/05; C22C 5/10

[58] Field of Search ..... 75/.5 A, .5 AC, 173 R, 75/173 A; 148/11.5 P; 252/514; 29/420.5, 192

[56] References Cited

UNITED STATES PATENTS

| | | | |
|---|---|---|---|
| 2,005,645 | 6/1935 | Bond et al. | 75/173 R |
| 3,501,287 | 3/1970 | Lever | 75/.5 A |

FOREIGN PATENTS OR APPLICATIONS

| | | | |
|---|---|---|---|
| 542,630 | 6/1957 | Canada | 75/173 A |
| 46-34761 | 12/1971 | Japan | 75/173 A |

*Primary Examiner*—W. Stallard

[57] ABSTRACT

Preparation of compositions of silver and $CeO_2$ by powder metallurgy techniques overcomes problems inherent in melting silver and pure cerium and subsequently internally oxidizing the cerium in the mixture. Small concentrations of $CeO_2$ substantially improve the electrical contact properties of silver. Silver with dispersed $CeO_2$ is superior to silver alone for use as an electrical contact because of much greater resistance to arc erosion and welding and only slightly higher contact resistance.

12 Claims, No Drawings

METHOD OF PREPARATION OF DISPERSION STRENGTHENED SILVER ELECTRICAL CONTACTS

BACKGROUND OF THE INVENTION

The field of this invention pertains to preparation of and materials for electrical contacts. Specifically, electrical contact materials comprising silver combined with small amounts of $CeO_2$ is the subject matter of this invention.

Pure silver, or high content silver alloys, such as silver/cadmium oxide, are extensively used for switch and relay applications. Any material which is a candidate for use as make and break contacts must have characteristics of low wear erosion and low tendency to stick or weld at fairly low current values. To meet the requirements of specific applications, such as sensitive relays, switches, thermostats, motor starters, contactors, circuit breakers and other electrical devices, many silver contact materials have been used, such as silver alloyed with other metals, or having metals or oxides or graphite as a dispersed phase therein.

Commercial silver alloys developed for specific applications are based on the best compromise of contact erosion, welding tendency, and low contact resistance (heat rise) and are generally limited to a maximum current value of 10–15 amperes when long life ($10^6$ operations) is required. Failure or end-of-life in these applications is generally reached because of (1) formation of a spike and crater erosion pattern, which may lead to bridging the contact gap and result in an interlocking type of weld; (2) actual welding of the contacts, which is considerably enhanced by excessive erosion, or the formation of small molten globules or whiskers on the contact surface and edges; or (3) the development of high and variable contact resistance which results in excessive heat or temperature rise.

It is known that the elevated temperature strength and hardness of metals can be significantly increased by the addition of a finely dispersed stable oxide phase. Theories of dispersion strengthening are well developed and good agreement of experimental data with theory has been observed. However, the effect of these oxides on the important electrical contact characteristics, such as arc erosion, weld tendency, and change in contact resistance, is little known and less understood. Silver-cadmium oxide is a contact material of this type, consisting of CdO dispersed in a silver matrix. Hovever, silver-cadmium oxide is in a special category, since CdO is not a stable oxide such as is required for dispersion strengthening, particularly at elevated temperature. In silver-cadmium oxide contacts the CdO phase is volatile and decomposes (at approximately 1700°-1750° F) during arcing; this feature gives this material its unique arc-quenching characteristics, especially when used in heavy current applications of 10–50 amps and higher. It should also be noted that these materials contain a fairly high oxide content, usually 10–15%. Even when present in small amounts there is no appreciable strengthening effect of CdO on silver, and above 15% CdO these alloys are too brittle to be fabricated by conventional methods. One of the outstanding properties contributed by CdO to silver is that it decreases the amount of material lost by arc erosion.

The prior art has been relatively silent in using $CeO_2$ as an agent for strengthening silver to yield an electrical contact material. U.S. Pat. No. 2,545,438 issued to M. J. Stumbock et al. discloses oxides of cerium in combination with silver for use as a spark plug electrode. That use is different from the subject matter of this disclosure in that a mechanical electrical contact has two contacts physically opening and closing with resulting electrical arcs.

A Japanese Patent Application of I. Morimoto et al., bearing Application No. Sho 47/1972-26542, dated Mar. 17, 1972, and Open Patent Publication No. Sho 48/1973-95311, dated Dec. 7, 1973, discloses an electrical contact material comprising silver and oxides of La, Ce, Pr, Nd, and Sm. Specifically the Japanese application shows electrical contact materials comprising silver and up to five mol percent of the oxides of La and Sm, having atomic numbers of 57 and 62 respectively, and since Ce has an atomic number of 56, the applicants assumed that $CeO_2$ would have a similar effect. The Japanese application teaches the preparation of silver-cerium group oxide compositions according to an internal oxidation process. This process begins by melting silver and one or more pure cerium group metals, and subsequently heating the alloy in air in a Tammann oven at 650° C for 250 hours, thereby selectively internally oxidizing the cerium group metal.

The composition which results from the process described above, e.g. $Ag/CeO_2$, was described in the Japanese application as having comparable arc-erosion, contact resistance and anti-welding properties with the well-known electrical contact material, silver and 12 weight percent cadmium oxide. The Japanese Open Patent Publication mentioned above describes the serious problem of preparing silver/cerium group oxide alloys by the internal oxidation process, especially where percentages of cerium group metals reach five atomic percent or more with silver. A crack in the contact may be caused by volume expansion due to the internal oxidation.

It is a general object of this invention to provide an improved powder metallurgy process for making an $Ag/CeO_2$ electrical contact material from which to fabricate an electrical contact having high resistance to arc erosion and welding with acceptable electrical contact resistance.

It is a specific object of this invention to provide an electrical contact made from a material prepared by a coprecipitating, admixing or coating step to yield a powder mixture of Ag and $CeO_2$ in desired proportions and a consolidating step to transform the powder to wire or sheet electrical contacts having parameters of low arc erosion and welding and low and stable surface contact resistance.

SUMMARY OF THE INVENTION

It has been discovered that preparation of $Ag/CeO_2$ compositions by improved powder metallurgy methods overcomes problems inherent in prior art methods.

Specifically it has been discovered that small additions to substantially pure silver of $CeO_2$ prepared by a coprecipitation, an admixing or a coating step followed by a consolidation step yield a material superior to pure silver in that electrical contacts made of the material have substantially less arc erosion, much lower tendency for welding and only slightly higher contact resistance. A mixture of 1¼ to 2½ percent by weight of $CeO_2$ with silver when used as an electrical contact yields the desired characteristics.

DESCRIPTION OF THE INVENTION

It has been discovered that silver (Ag) with dispersions of $CeO_2$ prepared by means of powder metallurgy techniques yields a composition having superior and unexpected characteristics which make it particularly suited as an electrical contact material.

The electrical contact composition of Ag and $CeO_2$ is prepared by a powder mixing step and then a consolidation step. The powder mixing step is preferably a coprecipitation step wherein a solution comprising a salt of silver and a salt of cerium is converted into a powder mixture of Ag and $CeO_2$. The consolidation step transforms the powder mixture of Ag and $CeO_2$ to wire or sheet material suitable for use as electrical contacts.

The coprecipitation step begins by mixing a solution of a silver salt, e.g., silver nitrate ($AgNO_3$), and a solution of a tervalent cerium salt, e.g., cerium nitrate ($Ce(NO_3)_3$), in the desired proportions. Ultimate percentage weight proportions of Ag and $CeO_2$ are achieved by adjusting the concentration of the salts in the solution and the relative proportion of each solution mixed together. Although it is preferred to use cerium nitrate ($Ce(NO_3)_3$) solution with the silver salt solution, other tervalent salts, such as cerium acetate ($Ce(C_2H_3O_2)_3$), or quadravalent salts, such as cerium ammonium nitrate ($(Ce(NO_3)_4).\ 2NH_4NO_3.\ 2H_2O$), may be used. A strong base, such as a sodium hydroxide solution, is added to the mixed solutions until the precipitation process is complete.

Although it is preferred to use nitrate of Ag and Ce, other salts may be used. The respective salts should be selected such that the anion of one does not form, with the cation of the other, a compound of lesser or even comparable solubility that the hydroxide of cerium and $Ag_2O$.

The mixed $Ag_2O$ and $Ce(OH)_3$ precipitates are filtered and washed in hot distilled water until the wash water is neutral. It is then dried at about 140° C, ground and sieved to a fine powder and heated at temperatures between 250° and 450° C for between 1 and 60 hours but preferably between 4 and 16 hours. The firing process converts the $Ag_2$ O to Ag and the $Ce(OH)_3$ to $CeO_2$. The result is a powder mixture of Ag and $CeO_2$. In order to achieve a very fine particle size mixture, it is desirable to heat the ground and sieved powder mixture in two stages. The first stage heating is carried out at a relatively low temperature, e.g. about or slightly greater than 250° C, for a relatively long time, e.g. 48 hours. After the first stage heating, the second stage heating is carried out at a relatively higher temperature e.g., about 350° C, for a relatively shorter time, e.g., 1 to 4 hours, whereupon the conversion to Ag and $CeO_2$ is completed.

The powder mixing step can also be performed by an admixing method. The admixing method begins with samples of high purity (99.99+ percent) silver powder. The silver powder is cleaned by boiling it in a solution containing equal parts by volume of HCl and distilled water. The silver powder is then rinsed with hot distilled water until the wash water is free of chloride. The $CeO_2$ is then dispersed in distilled water to form a colloidal solution and the silver powder is added to the solution. This mixture is milled to coat the surface of and to uniformly distribute $CeO_2$ particles throughout the silver powder. The colloidal suspension is then dried, and the residue which results is ground and sieved to a fine powder mixture of Ag and $CeO_2$.

As a third alternative for the mixing step, the Ag/-$CeO_2$ composition may be prepared by adding high-purity (99.99+%) silver powder, cleaned as described in the prior paragraph, to a solution of a cerium salt, such as $Ce(NO_3)_3$, and then evaporating the solution to dryness with continuous stirring. The cerium salt solution should contain sufficient cerium, in relation to the silver powder, to provide the desired amount of $CeO_2$ after completing the process described in this paragraph. The concentration of the cerium salt solution is preferably dilute. The resulting silver powder, coated with solid-phase cerium salt, is then heated at temperatures in the range of about 250°–450° C, advantageously to at least 420° C, to convert the cerium salt to $CeO_2$ dispersed on the surface of the silver particles. The solid product may then be ground and sieved to a fine powder, and processed as described hereinafter in the consolidation step.

The consolidation step comprises pressing, sintering and working sub-steps which yield wire or sheet suitable for electrical contact material. The powder mixture of Ag and $CeO_2$ can be pressed while it is hot or cold. For example, it can be isostatically pressed by placing it in a very flexible sealed container, e.g., a latex rubber sack, and pressing it at 30,000 psi to form a bar or billet. The bar is then sintered at temperatures of from 700° to 900° C for 2 hours and then cooled to room temperature.

Working of the sintered bars or billets can be accomplished by cold working or hot extrusion. In cold working, the sintered bars are cold swaged to smaller diameters with intermediate anneals after which the small diameter bars may be drawn to yield small diameter wires. The wire may be headed into rivets for use as electrical contacts. Sheet material may be similarly prepared by hot or cold rolling techniques. The sheet material can then be headed into electrical contact rivets.

In the preferred hot extrusion method, three inch diameter sintered billets are hot extruded to approximately 0.340 inch diameter rods. The rod is then swaged, drawn into wire and headed into rivets for use as electrical contacts.

Arc erosion is the loss or transfer of material which takes place due to arcing across the contacts. With AC current the loss generally takes place on both contacts; however if one contact reaches a higher temperature, a directional transfer from the hotter to the cooler contact can occur. With DC current the material transfer is always highly directional: negative transfer is defined as a build-up of a spike on the cathode with a corresponding crater on the anode, and positive transfer is the formation of a spike on the anode and a crater on the cathode. The direction and amount of transfer that takes place depends upon whether the operating current and voltage conditions are above or below the minimum arcing current and voltage for that material. The minimum arcing current is the highest current that can be interrupted at different voltages without arcing; the minimum arcing voltage is the lowest voltage at which an arc will form at atmospheric pressure. Negative transfer is generally associated with the short arc on make, or when the contacts are operated below the critical arcing current and voltage characteristic for that material; positive transfer is generally associated with the anode arc on break, particularly when the contacts are operated above the critical arcing current and voltage. Negative transfer, frequently called bridge transfer, is generally characterized by sharply local transfer resulting in a tall spike and a deep crater; positive transfer is usually a more desirable type, since it is more diffuse and takes place over a larger area.

One of the common modes of failure of silver and silver alloys in switches and relay contacts is excessive transfer due to arc erosion. Therefore, high current DC make-arcs, which produce a highly localized negative transfer on silver, are used to evaluate the arc erosion of the various dispersion strengthened silver alloys.

Weld tendency as measured by the number of welds which occur in a given number of operations, and also the maximum weld strength when welding takes place, is another criterion which is used for evaluating the various dispersion hardened silver alloys against pure silver. Silver alloys are limited in many applications because of the tendency for welding, especially above current of approximately 10–15 ampere. When excessive metal transfer takes place in the form of a spike and crater, it may result in an interlocking type of weld; as additional transfer takes place, welding tendency increases rapidly.

The overall resistance of a pair of electrical contacts is the sum of three components: bulk resistance, film resistance, and constriction resistance. Bulk resistance is the normal or ohmic resistance, which is dependent upon the chemical composition of the material and its physical dimensions. It is calculated by multiplying the resistivity of the contact material by its thickness and dividing by the area. Pure silver contacts have low bulk resistance, because of the inherent low resistivity of silver.

Film resistance is the resistance which develops on the surface of an electrical contact due to oxidation, corrosion, or other chemical reactions between the contact material and the surrounding media. This can also include mechanical films that are formed by dirt, dust, oil or foreign materials. Pure silver has fairly high film resistance because of its tendency to form silver sulfide.

Constriction resistance or surface contact resistance is the resistance across the actual area of contact between the two mating surfaces of the electrical contacts where they touch each other. The actual area of contact is quite small compared to the apparent or geometric area, since no matter how smooth two mating contact surfaces are made, they will still consist of many peaks and valleys, and when they are brought together they will actually touch only at the peaks—called asperities—and these are relatively few in number. Actual measurements of contact resistance generally give values which are equal to 10 to 20 times the sum of bulk resistance and film resistance, showing that the surface contact resistance, usually called the constriction resistance, is the most significant component of the total resistance. This is especially true in pure silver and high silver content alloys, since the bulk resistance and film resistance (in the absence of sulfur) of these alloys are very low. Therefore, the measurement of contact resistance of these alloys essentially indicates the surface contact resistance. A low stable surface contact resistance is one of the outstanding characteristics of silver and high silver-content alloys. This is important in relays and contactors, since high contact resistance causes high temperature rise. This resistance should not exceed a target value (below 1–10 milliohms) and should be stable with the number of operations in order to minimize excessive heating and temperature rise. Therefore, the initial surface contact resistance, as well as change of resistance during life testing, is an important characteristic of the material.

The alloy of the silver and $CeO_2$ prepared by powder metallurgy technique has been discovered to be exceptionally desirable as an electrical contact material. The term alloy is used to indicate a mixture or composition of silver and $CeO_2$. Different percentages by weight or $CeO_2$ were added to substantially pure silver. The resulting different alloys were then tested in order to evaluate their respective efficacy as electrical contact material.

TABLE I

Dispersion Strengthened Silver Alloys Tested as Electrical Contacts

| Alloy | Composition | % Wt. $CeO_2$ |
|---|---|---|
| A | Ag | — |
| B | $Ag + CeO_2$ | 0.5 |
| C | $Ag + CeO_2$ | 1.0 |
| D | $Ag + CeO_2$ | 1.5 |
| E | $Ag + CeO_2$ | 2.5 |

Table I shows the different alloys tested. The pure silver control sample, A, and the various dispersion strengthened silver alloys, B through E, have been evaluated for arc erosion, welding tendency, and surface contact resistance. Testing equipment was used to carry out life and performance tests for evaluation. The equipment comprises an electro-hydraulic servo-controlled system in which the moving contact is operated through a bellows system at a varied and controlled cyclic rate, contact gap, and velocity against the stationary contact also supported on a bellows system, which is backed up by a temperature controlled dashpot system.

The effect of make and break arcs on erosion is determined by weight loss of the contacts. The frequency of welding and the actual weld strength is recorded continuously from a transducer system. The contact resistance is measured by means of a low-current system at various contact pressures.

A high current d.c. make-arc was chosen as the test method. An arc current of 100 amperes was selected for testing these alloys as the best compromise between welding and arc erosion for arc accelerated life test. Table II indicates test conditions to measure contact properties for the various compositions of Table I.

TABLE II

Experimental Conditions Used for Evaluation of Electrical Contact Properties of Dispersion Strengthened Silver Alloys

| Variable | Value |
|---|---|
| Velocity (cm/sec) | 2.5 |
| Frequency (Hz) | 0.3 |
| Contact Gap (in.) | 0.150 |
| Contact Overtravel (in.) | 0.070 |
| Make-Force (gm) | 700 |
| Weld Force (gm), max. | 1200 |
| Contact Bounce | None |
| Atmosphere | Air |
| Flow Rate (liters/min. of air) | 1 |
| Voltage, open circuit (volts) | 125 |
| Resistance (ohm) | 0.4 |
| Arc Current (amperes) | 100 |
| Make/Break Arc | Make Only |

The dispersion hardened silver alloys, along with the pure silver control sample were fabricated into 0.080 inch sheets.

Discs of ¼ inch diameter were cut from these sheets then brazed to a standard copper rivet for use in contact testing equipment. The brazing was carried out in an atmosphere of 95% nitrogen-5% hydrogen employing a commercially available silver solder. After brazing, the composite contact was machine finished to final diameter and thickness with a 1 radius. The test results for certain of the dispersion hardened silver alloys showed improvements in the test parameters over the pure silver sample.

TABLE III

Anode Loss Due To Arc Erosion After 10,000 Operations With A 100 Amp Make-Arc

| Alloy | Anode Loss, mg | Relative Wt. Loss Ratio |
|---|---|---|
| A | 75 | 1.00 |
| B | 90 | 1.20 |
| C | 85 | 1.13 |
| D | 20 | 0.27 |
| E | 33 | 0.44 |

TABLE IV

Anode Loss Due To Arc Erosion After 20,000 Operations With A 100 Amp Make-Arc

| Alloy | Anode Loss, mg | Relative Wt. Loss Ratio |
|---|---|---|
| A | 150 | 1.00 |
| B | 180 | 1.20 |
| D | 20 | 0.13 |
| E | 50 | 0.33 |

TABLE V

Anode Loss Due To Arc Erosion After 30,000 Operations With A 100 Amp Make-Arc

| Alloy | Anode Loss, mg | Relative Wt. Loss Ratio |
|---|---|---|
| A | 225 | 1.00 |
| B | 270 | 1.20 |
| D | 45 | 0.20 |
| E | 60 | 0.27 |

TABLE VI

Anode Loss Due To Arc Erosion After 35,000 Operations With A 100 Amp Make-Arc

| Alloy | Anode Loss, mg | Relative Wt. Loss Ratio |
|---|---|---|
| A | 260 | 1.00 |
| B | 310 | 1.20 |
| D | 65 | 0.25 |
| E | 70 | 0.27 |

Tables III through VI show the relative anode weight loss for electrical contacts for alloys A through E, each table showing results for a fixed number of operations of a 100 Amp Make Arc. Examination of these tables discloses that alloys (e.g., alloys B and C) of silver containing up to 1.0 percent be weight of $CeO_2$ yields increases of anode weight loss when compared with the results of alloy A, which is pure silver. In fact, alloy B, which is a composition of silver and 0.5 percent by weight of $CeO_2$ yields a constant factor of 1.2 more anode loss than does alloy A, pure silver.

Alloy D and E, 1.5 and 2.5 percent additions of $CeO_2$ to silver respectively, show dramatic and unexpected reductions of electrical contact anode weight loss when compared to pure silver, alloy A. after 35,000 cycles of testing, Table VI shows that electrical contact alloys with 1.5 or 2.5 percent $CeO_2$ with silver have only approximately one-fourth as much weight loss as electrical contact alloys made from pure silver.

TABLE VII

Percentage of Total Welds (110 gms) After 10,000 Operations with a 100 Amp Make-Arc

| Alloy | % Total Welds | Ratio to Pure Silver |
|---|---|---|
| A | 60 | 1.00 |
| B | 26 | .43 |
| C | 19 | .32 |
| D | 16 | .27 |
| E | 11 | .18 |

The effect of the addition of small amounts of $CeO_2$ to pure silver on the electrical contact welding characteristics is shown in Table VII. It will be noted that the weld frequency of pure silver is reduced approximately by a factor of three with the additions of small percentages by weight of $CeO_2$.

Further, it should be pointed out that not only do small additions of $CeO_2$ to silver give substantial improvement in electrical contact erosion and welding properties, the alloys also exhibit changes in the nature of the anode-cathode material transfer. Pure silver after 15,000 operations had a large negative transfer with a deep crater in the anode and a high peak on the cathode. The addition of 0.5% $CeO_2$ and 1.0% $CeO_2$ increases the erosion and also increased the negative transfer. As previously discussed, welding characteristics were substantially improved, even with these deep craters and high peaks. With the addition of more than 1% $CeO_2$ the erosion dramatically becomes very low, and is accompanied by substantially less transfer. This effect typically occurs at about 1¼% $CeO_2$, but the minimum effective amount may be somewhat dependent upon the particle size and distribution of the dispersed phase. The largest amount of $CeO_2$ tested was 2.5 wt.%. Larger quantities are expected also to be effective, but due to increased difficulties in working such Ag/$CeO_2$ mixtures, there appears to be little advantage to the use of larger amounts of $CeO_2$. The presence in the range of about 1¼% to about 2½% $CeO_2$ gives a rather uniform loss of material on the entire anode surface, without a crater-peak transfer. This type transfer is similar to that achieved in 5 to 7 weight percentage addition of CdO to silver, and which is very desirable for obtaining maximum life electrical contacts.

The addition of about 1¼ to 2½ percent by weight $CeO_2$ to silver yields alloys having lower contact resistance than alloys containing silver and 5 to 7 percent by weight additions of CdO. Since all three characteristics, low erosion, low welding, low contact resistance, of a good electrical contact material are substantially and unexpectedly improved, alloys of silver with small additions of $CeO_2$ are outstanding alternatives to prior art electrical contact materials. The preparation of silver/-$CeO_2$ contacts by powder metallurgy techniques avoids problems inherent in preparation by internal oxidation.

What is claimed is:

1. The method of preparing a composition of Ag and $CeO_2$ comprising the steps of preparing a powder mixture of Ag and from about 1¼ to about 2½ percent by weight of $CeO_2$, consolidating said powder mixture into a solid billet, and mechanically reducing said solid billet into an electrical contact body.

2. The method of claim 1 wherein the preparing of a powder mixture step comprises the sub-steps of forming a mixed solution by mixing a solution of a silver salt with a solution of a cerium salt, precipitating a mixture of precipitates of $Ag_2O$ and $Ce(OH)_3$ by adding a base to said mixed solution, filtering and washing the mixture of precipitates, drying the mixture of precipitates, grinding said mixture of precipitates to a fine powder, and heating said powder at temperature between about 250° and about 450° C from between about 1 and about 60 hours to yield a powder mixture of Ag and $CeO_2$.

3. The method of claim 1 wherein the preparing of a powder mixture step comprises the sub-steps of forming a mixed solution by mixing a solution of a silver salt with a solution of a cerium salt, precipitating a mixture of precipitates of $Ag_2O$ and $Ce(OH)_3$ by adding a base to said mixed solution, filtering and washing the mixture of precipitates, drying the mixture of precipitates, grinding said mixture of precipitates to a fine powder, heating said powder at a relatively low temperature of about 250° C for a relatively long time of about 48 hours, and then heating said powder at a relatively high temperature of about 350° C for a relatively short time of from about 1 to 4 hours.

4. The method of claim 1 wherein said consolidating step comprises placing said powder mixture of Ag and $CeO_2$ into a flexible sealed container, hydrostatically pressing it at 30,000 psi to form a solid billet, and then sintering said billet at a temperature between about 700° to 900° C for about 2 hours.

5. The method of claim 1 wherein said reducing step comprises the sub-steps of hot extruding of the solid billet into a small diameter rod, drawing said rod into smaller diameter rods, and forming said smaller diameter rods into an electrical contact body.

6. The method of claim 1 wherein said reducing step comprises the sub-steps of cold swaging said solid billet with intermediate anneals to smaller diameter rods, drawing the smaller diameter rods to even smaller diameter wire, and forming said wire into an electrical contact body.

7. The method of claim 1 wherein said reducing step comprises the steps of hot rolling said billet into a sheet, and forming said sheet into an electrical contact body.

8. The method of claim 1 wherein said reducing step comprises the steps of cold rolling said solid billet into a sheet, and forming said sheet into an electrical contact body.

9. The method of preparing a composition of Ag and from about 1¼ to about 2½ percent by weight of $CeO_2$ comprising the steps of adding high-purity silver powder to a cerium salt solution to yield a mixed solution, heating said mixed solution until the solution evaporates leaving a powder of Ag particles coated with a cerium salt, heating said silver particles at a temperature in the range of about 250°to about 450° C, until said cerium salt is converted to $CeO_2$, grinding and sieving the resulting powder, consolidating said powder mixture into a solid billet, and mechanically reducing said billet into an electrical contact rivet.

10. The method of preparing a composition of Ag and from about 1¼ to about 2½ percent by weight of $CeO_2$ comprising the steps of forming a colloidal solution of substantially pure powered Ag and powered $CeO_2$ in distilled water, milling said solution to uniformly distribute $CeO_2$ particles throughout the Ag powder, drying said solution to yield a powder mixture of Ag and $CeO_2$, consolidating said powder mixture into a solid billet, and mechanically reducing said solid billet into an electrical contract rivet.

11. The method of claim 10 wherein the preparing of a powder mixture step further comprises the step of, grinding and sieving said powder mixture of Ag and $CeO_2$.

12. An electrical contact made from material comprising substantially pure silver mixed with from about 1¼ to about 2½ percent by weight of $CeO_2$, said material prepared by the steps comprising:

preparing a powder mixture of Ag and from about 1¼ to about 2½ percent by weight of $CeO_2$, consolidating said powder mixture into a solid billet, and mechanically reducing said solid billet into an electrical contact body.

* * * * *